United States Patent [19]

Venus et al.

[11] 4,033,470

[45] July 5, 1977

[54] SAND AND GRAVEL DREDGES

[76] Inventors: James Venus, Appledore, England; David Charlton, deceased, late of North Shields, England; by Martha Charlton, administratrix, 1Eleanor Street, Cullercoats, North Shields, Northumberland, NE30 4PG, England

[22] Filed: June 13, 1974

[21] Appl. No.: 479,129

[30] Foreign Application Priority Data

June 13, 1973 United Kingdom ..... 28220/73

[52] U.S. Cl. ..... 214/152; 114/27; 214/14; 214/15 B; 302/15

[51] Int. Cl.[2] ..... B65G 53/30

[58] Field of Search ..... 214/15 B, 14, 152; 114/27; 302/14, 15

[56] References Cited

UNITED STATES PATENTS

| | | | |
|---|---|---|---|
| 1,127,137 | 2/1915 | West | 214/15 B |
| 3,690,730 | 9/1972 | Sakata | 214/15 B X |
| 3,729,232 | 4/1973 | Sakata | 302/15 |
| 3,812,984 | 5/1974 | Cladingboel | 214/15 B |

*Primary Examiner*—L. J. Paperner
*Assistant Examiner*—George F. Abraham
*Attorney, Agent, or Firm*—Rose & Edell

[57] ABSTRACT

The invention relates to a sand and gravel dredge in which, for discharge ashore, the cargo is re-slurried in the hold by high pressure oscillating water jets at the center of the hold floor, creating a turbulent region from which the re-slurried material enters a duct keel through selectively-operable valves and is pumped to dewatering screens at deck level. The dewatered material from the screens is conveyed ashore and the water passing through the screens is directed into settling tanks from where it is recirculated to the high pressure jets.

3 Claims, 6 Drawing Figures

SAND AND GRAVEL DREDGES

This invention relates to sand and gravel dredges and, more specifically, to the equipment on board ship for unloading the cargo. It is an object of the invention to achieve a system for high speed delivery of the cargo ashore in a substantially dry state.

According to the present invention, the cargo is decompacted and re-slurried by means of water under pressure, pumped to dewatering screens aboard ship and conveyed ashore after dewatering. Preferably, a high water pressure of not less than 100 p.s.i is employed.

To break up and re-slurry the compacted cargo, oscillating high pressure jets may be provided, the high pressure water being injected into the floor of the hold and creating a highly turbulent region. In the preferred arrangement, the vessel is constructed with a duct keel and the re-slurried material is admitted thereto from the turbulent region by appropriate valves, whereafter it is pumped to the screens at deck level. After screening, the cargo may be conveyed ashore by conventional conveying arrangements, and the water and fines from the screens recirculated.

One particular ship equiped according to the invention will now be described by way of example with reference to the accompanying drawings, in which.

Figure 1:
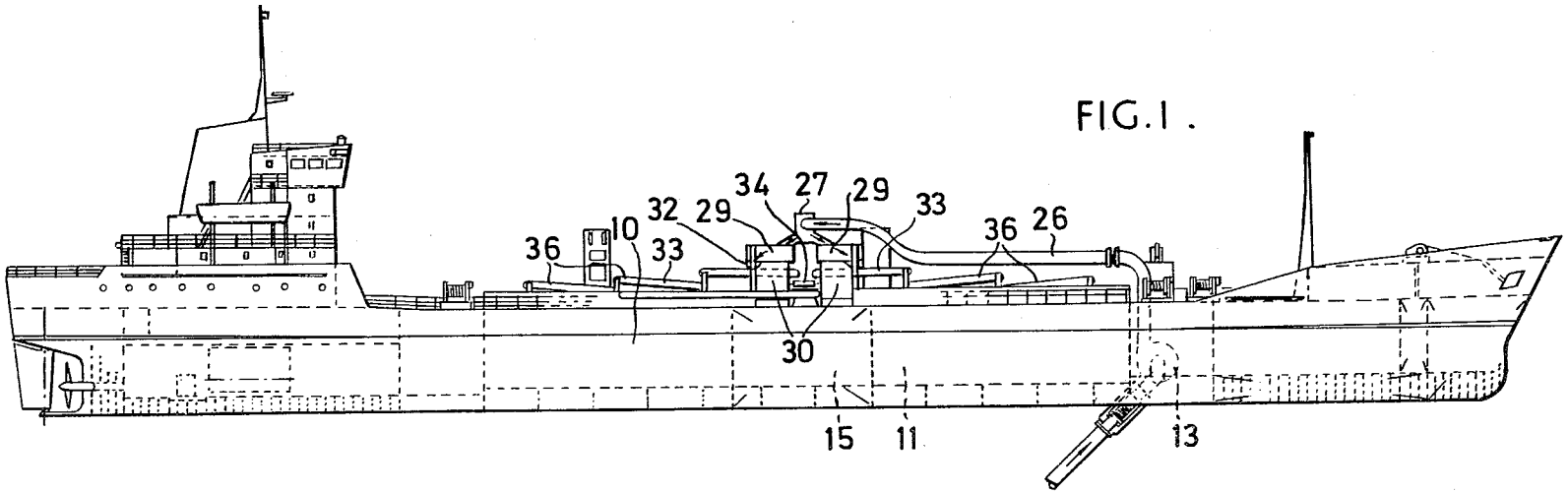
FIG. 1 is a side elevation of the ship.
Figure 2:
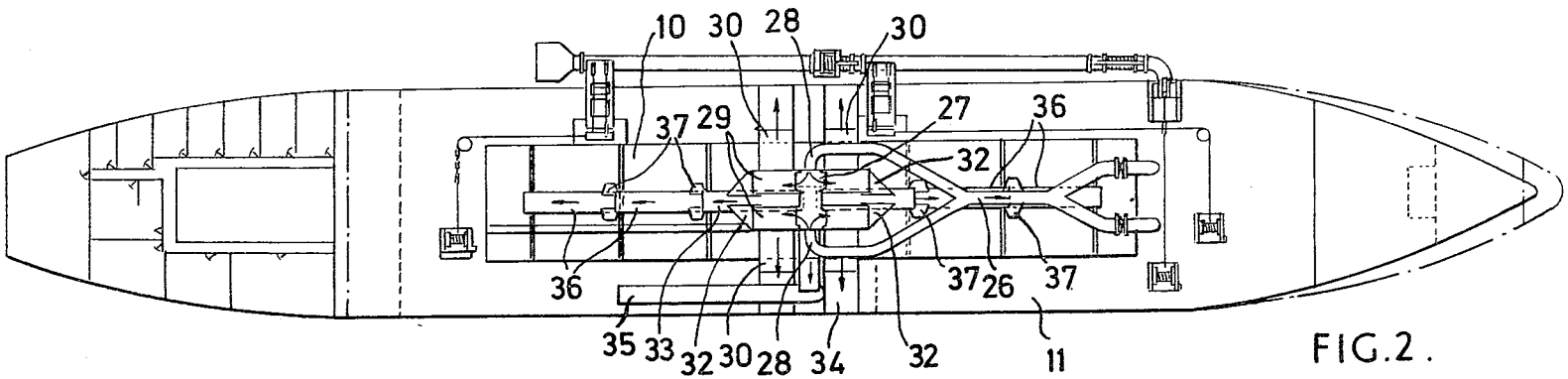
FIG. 2 is a plan of the main deck.
Figure 3:
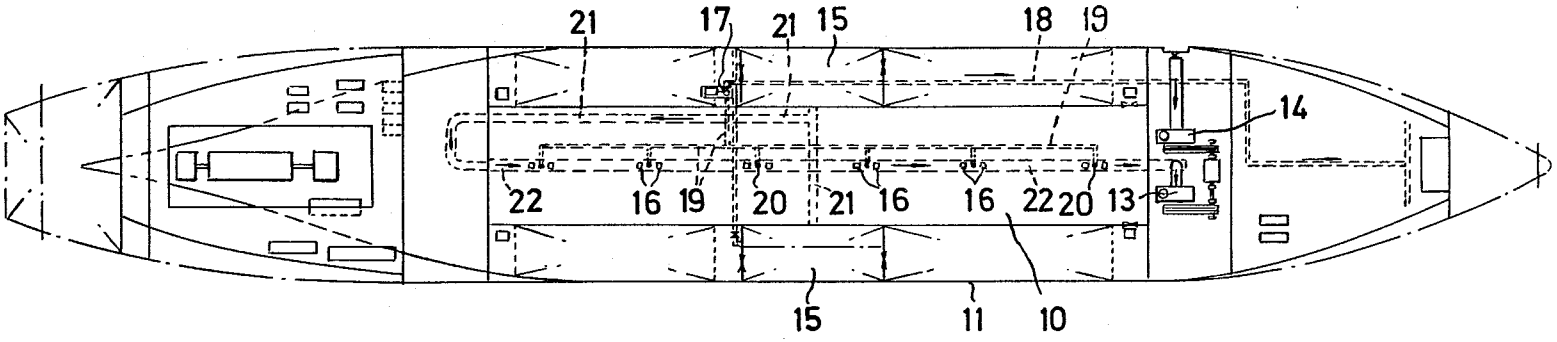
FIG. 3 is a plan view at tank top level.
Figure 4:
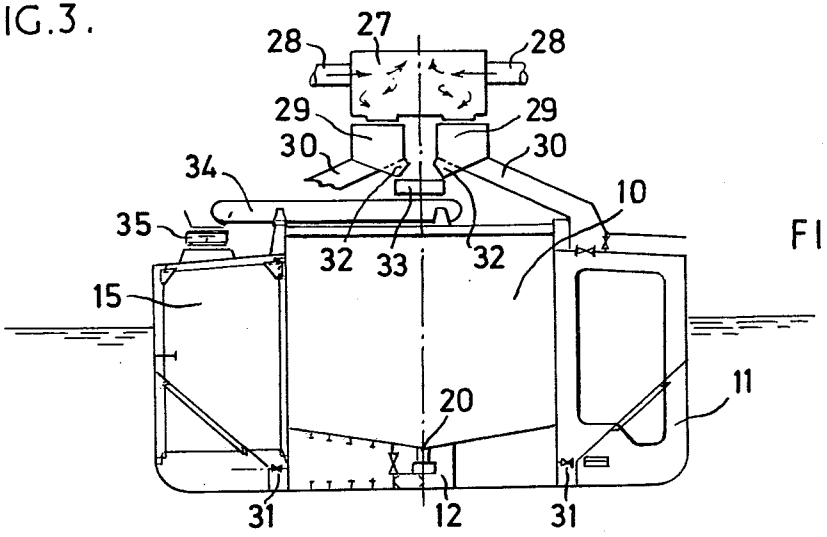
FIG. 4 is a cross sectional view.

The system to be particularly described has been specifically designed for the unloading of sand and gravel dredges and all of the necessary equipment is contained on board ship. This equipment enables dry cargo, having an approximate density of 130 pounds per cubic foot, to be deposited ashore at a rate of 2200 tons per hour maximum. The material to be handled is mainly gravel, the particle size ranging from 6mm to 60mm with the occasional large stone up to 200mm.

Referring firstly to FIGS. 1 to 4, the vessel 11 is constructed with a duct keel 12, and an unloading pump 13, of similar construction to the dredge pump 14, draws sea water via keel ducts 21, 22 from port and starboard settling tanks 15 which are situated amidships. The unloading pump 13 is capable of handling a total mixture flow of 25,600 gallons per minute and the unloading performance is based on the mixture containing 15% solids by volume. This mixture is achieved by injecting high pressure water into the floor of the cargo hold 10 through slowly oscillating jet heads 20. The water is supplied via piping 19 by a jet assist pump 17 which also operates bow thrust units via piping 18 and has a capacity of some 4000 gallons per minute at a supply pressure of 200 pounds per square inch.

The high pressure jets break up the compacted cargo and create a highly turbulent region in the floor of the hold 10. This severe agitation holds the particles in suspension above pneumatically-operated blade valves 16 which control the inflow of solids to the central keel duct 22, the material thus entering the duct 22 being carried along the circulating sea water to the suction of the pump 13. In order to assist the flow of material within the hold, high pressure water is also added to the cargo at approximately deck level. The quantity is similar to that injected by the oscillating jets 20 and is sufficient to overcome the adhesive properties of such a dredged cargo.

Figure 5:
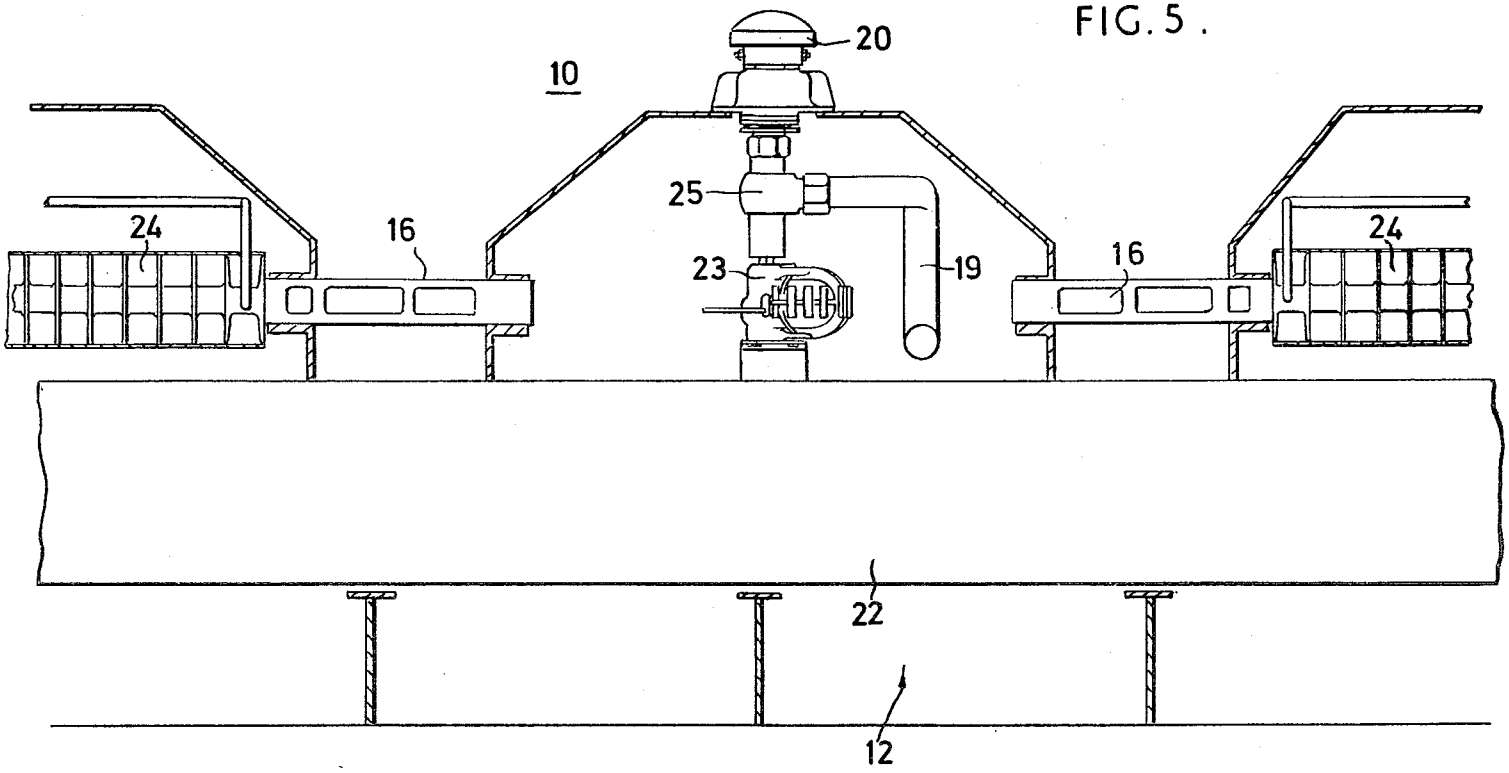
FIG. 5 shows, in elevation, the equipment at tank top level in more detail.
Figure 6:
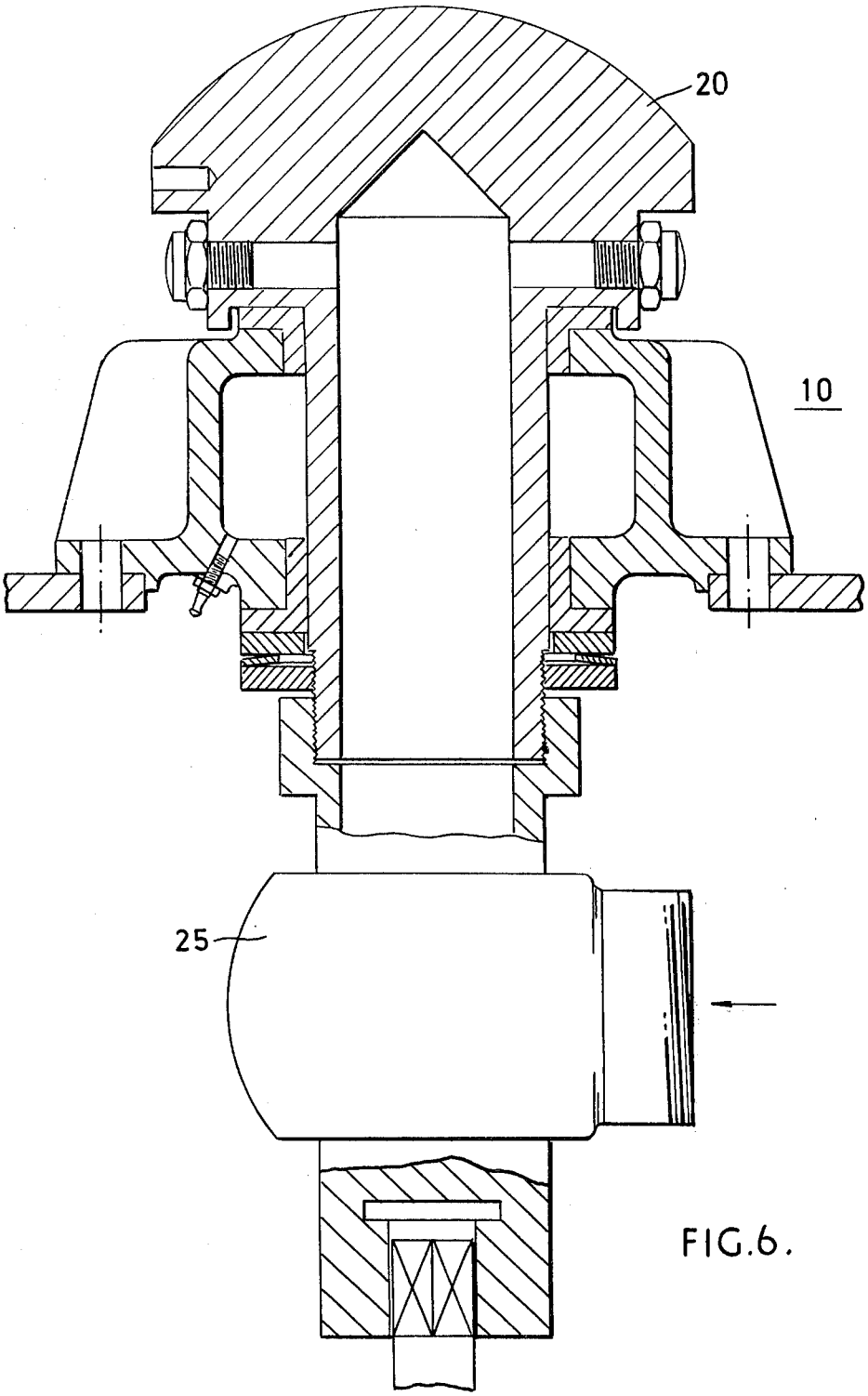
FIG. 6 is a vertical section through a jet head.

Referring now to FIGS. 5 and 6, twelve blade valves 16 are spaced along the length of the keel duct 22, two adjacent to each jetting station and rotary motion of the jet heads 20 is achieved by rotary pneumatic actuators 23 mounted beneath the floor of the hold. The high pressure water is delivered to the jets via rotary couplings 25. Each blade valve is operated by a linear pneumatic actuator 24 and incorporates an inflatable seal which prevents the ingress of air when the valve is not in use.

The mixture drawn from the duct keel by the unloading pump 13 is delivered via a pipe 26 to a baffle box 27 which is situated on deck. The baffle box has two inlets 28 which are disposed opposite one another and the energy of the two inlet streams, is therefore, destroyed. Baffles inside the box further slow the velocity of the mixture and ensure an even discharge to the vibrating screens 29 which are mounted below the baffle box. The vibrating screens are of special construction and whilst they are mounted generally horizontally, there is a variation in inclination of the screen deck within the support casing. The total enclosure of each screen prevents any water loss from the system.

Four such screens 29, each 6 feet wide by 12 feet long, are included in the system and a 5/16 inch spacing on the rod deck enables the water and fines to pass through each screen quickly and efficiently whilst the larger solids which constitute the valuable cargo are retained. The underflow from the screens 29 is collected in deep troughs 30 through which the water passes by gravity back to the settling tanks 15 for recirculation.

The settling tanks 15 will initially contain approximately 500 tons of clean sea water which is taken on board as the vessel approaches the harbour. Fine particles will be washed from the cargo during the unloading operation and to prevent dockside pollution, these fines are retained in the settling tanks. High level suction points enable comparatively clean water to be taken from the settling tanks for unloading and cargo jetting purposes and when the vessel returns to open water, the fines are dumped and the tanks are flushed out. The settling tanks have hopper bottoms to facilitate this cleaning operation with bottom opening valves 31 identical to those provided on the duct keel.

The dewatered solids pass over the ends of the vibrating screen decks and are guided by chutes 32 on to reversible fore and aft conveyors 33 which in turn dump the material on to a transverse conveyor 34 delivering to a 50 feet long boom conveyor 35 that can be swung outboard to discharge ashore.

The screening equipment is also used during the loading operation to grade the cargo as it is taken on board, the delivery of the loading pump 14 being connected to the pipe 26. A dry, graded cargo is distributed within the hold by a conveyor system 36 which receives the cargo from the conveyors 33, now running reversed, and has several discharge points 37.

We claim:

1. A method of unloading a cargo of dredged sand or gravel or the like from a hold of a ship, said ship having a longitudinally extending duct keel below the floor of the hold, comprising the steps of:

a. pumping a stream of water from tank storage along the duct keel and thence up to deck level;

b. injecting high pressure jets of water into the cargo at a level just above the floor of the hold and oscillating those jets, the jet water pressure being not less than 100 psi, thereby to create a highly turbulent region in which the cargo is decompacted and re-slurried;

c. opening valves to admit decompacted and re-slurried cargo material from this turbulent region into the stream of water flowing along the duct keel;

d. pumping said cargo material from the duct keel up to deck level;

e. de-watering said cargo material at deck level;

f. discharging the de-watered material outboard.

2. The method according to claim 1 further comprising collecting the water freed from the cargo material by the de-watering step in settling tanks, and drawing from the settling tanks the water supply for the high pressure jets.

3. A method according to claim 1, wherein high pressure water is also introduced into the cargo in the hold at approximately deck level.

* * * * *